US007385350B2

(12) United States Patent
Eden et al.

(10) Patent No.: US 7,385,350 B2
(45) Date of Patent: Jun. 10, 2008

(54) ARRAYS OF MICROCAVITY PLASMA DEVICES WITH DIELECTRIC ENCAPSULATED ELECTRODES

(75) Inventors: J. Gary Eden, Mahomet, IL (US); Sung-Jin Park, Champaign, IL (US)

(73) Assignee: The Broad of Trusstees of the University of Illinois, Urbana, IL (US)

( * ) Notice: Subject to any disclaimer, the term of this patent is extended or adjusted under 35 U.S.C. 154(b) by 148 days.

(21) Appl. No.: 11/487,949

(22) Filed: Jul. 17, 2006

(65) Prior Publication Data

US 2007/0170866 A1 Jul. 26, 2007

Related U.S. Application Data

(63) Continuation-in-part of application No. 10/958,174, filed on Oct. 4, 2004, now Pat. No. 7,297,041, and a continuation-in-part of application No. 10/958,175, filed on Oct. 4, 2004.

(60) Provisional application No. 60/699,475, filed on Jul. 15, 2005.

(51) Int. Cl.
*H01J 17/49* (2006.01)

(52) U.S. Cl. ..... 313/582; 313/631

(58) Field of Classification Search ..... 313/582, 313/584, 586, 631

See application file for complete search history.

(56) References Cited

U.S. PATENT DOCUMENTS 3,487,254 A 12/1969 Vollmer
3,697,797 A 10/1972 Freyheit et al.
3,793,552 A 2/1974 Glascock et al.

(Continued)

FOREIGN PATENT DOCUMENTS

JP 7192701 7/1995

OTHER PUBLICATIONS

A., El-Habachi et al., Sep. 15, 2000, "Series operation of direct current xenon chloride excimer sources," Jounral of Applied Physics, vol. 88, No. 6, pp. 3220-3224.

(Continued)

*Primary Examiner*—Vip Patel
(74) *Attorney, Agent, or Firm*—Greer, Burns & Crain, Ltd.

(57) ABSTRACT

The invention concerns microcavity plasma devices and arrays with thin foil metal electrodes protected by metal oxide dielectric. Devices of the invention are amenable to mass production techniques, and may, for example, be fabricated by roll to roll processing. Exemplary devices of the invention are flexible. Embodiments of the invention provide for large arrays of microcavity plasma devices that can be made inexpensively. The structure of preferred embodiment microcavity plasma devices of the invention is based upon thin foils of metal that are available or can be produced in arbitrary lengths, such as on rolls. In a device of the invention, a pattern of microcavities is produced in a metal foil. Oxide is subsequently grown on the foil and within the microcavities (where plasma is to be produced) to protect the microcavity and electrically isolate the foil. A second metal foil is also encapsulated with oxide and is bonded to the first encapsulated foil. For preferred embodiment microcavity plasma device arrays of the invention, no particular alignment is necessary during bonding of the two encapsulated foils. A thin glass layer or vacuum packaging, for example, is able to seal the discharge medium into the array.

20 Claims, 11 Drawing Sheets

U.S. PATENT DOCUMENTS

| | | | |
|---|---|---|---|
| 3,908,147 | A | 9/1975 | Hall et al. |
| 3,970,887 | A | 7/1976 | Smith et al. |
| 4,060,748 | A | 11/1977 | Bayless |
| 4,370,797 | A | 2/1983 | van Gorkom et al. |
| 4,459,636 | A | 7/1984 | Meister et al. |
| 4,672,624 | A | 6/1987 | Ford |
| 4,698,546 | A | 10/1987 | Maitland et al. |
| 4,808,883 | A | 2/1989 | Iwaya et al. |
| 4,890,031 | A | 12/1989 | Zwier |
| 4,988,918 | A | 1/1991 | Mori et al. |
| 4,992,703 | A | 2/1991 | Ramaiah |
| 5,013,902 | A | 5/1991 | Allard |
| 5,055,979 | A | 10/1991 | Boland et al. |
| 5,062,116 | A | 10/1991 | Christensen |
| 5,200,973 | A | 4/1993 | Ford |
| 5,387,805 | A | 2/1995 | Metzler et al. |
| 5,438,343 | A | 8/1995 | Khan et al. |
| 5,496,199 | A | 3/1996 | Makishima et al. |
| 5,514,847 | A | 5/1996 | Makishima et al. |
| 5,686,789 | A | 11/1997 | Schoenbach et al. |
| 5,926,496 | A | 7/1999 | Ho et al. |
| 5,939,829 | A | 8/1999 | Schoenbach et al. |
| 5,990,620 | A | 11/1999 | Lepselter |
| 6,016,027 | A | 1/2000 | DeTemple et al. |
| 6,082,294 | A | 7/2000 | Simpson |
| 6,139,384 | A | 10/2000 | DeTemple et al. |
| 6,194,833 | B1 | 2/2001 | DeTemple et al. |
| 6,346,770 | B1 | 2/2002 | Schoenbach et al. |
| 6,353,289 | B1 | 3/2002 | Ishigami et al. |
| 6,433,480 | B1 | 8/2002 | Stark et al. |
| 6,541,915 | B2 | 4/2003 | Eden et al. |
| 6,563,257 | B2 | 5/2003 | Vojak et al. |
| 6,695,664 | B2 | 2/2004 | Eden et al. |
| 6,815,891 | B2 | 11/2004 | Eden et al. |
| 6,828,730 | B2 | 12/2004 | Eden et al. |
| 6,867,548 | B2 | 3/2005 | Eden et al. |
| 2002/0036461 | A1 | 3/2002 | Schoenbach et al. |
| 2003/0132693 | A1 | 7/2003 | Eden et al. |
| 2003/0230983 | A1 | 12/2003 | Vonallmen |
| 2004/0100194 | A1 | 5/2004 | Eden et al. |
| 2004/0160162 | A1 | 8/2004 | Eden et al. |
| 2005/0148270 | A1 | 7/2005 | Eden et al. |
| 2005/0269953 | A1 | 12/2005 | Eden et al. |
| 2006/0038490 | A1 | 2/2006 | Eden et al. |

OTHER PUBLICATIONS

K. H. Schoenbach, et al, Jan. 1996., "Microhollow cathode discharges," Appl. Phys. Lett., vol. 68, No. 1, pp. 13-15.

L. D. Biborosch, et al, Dec. 20, 1999, "Microdischarges with plane cathodes," Appl. Phys. Lett., vol. 75, No. 25, Dec. 20, 1999, pp. 3926-3928.

S. J. Park, et al, Jul. 10, 2000, "Flexible microdicharge arrays: Metal/polymer devices", Applied Physics Letters, vol. 77, No. 2, pp. 199-201.

J.W. Frame et al., Sep. 1997, "Microdischarge devices fabricated in silicon", Applied Physics Letters, vol. 71, No. 9, pp. 1165-1167.

J.W. Frame,et al., May 25, 1998, "Continuous-wave emisssion in the ultrviolet from diatomic excimers in a microdischarge", Applied Physics Letters, vol. 72, No. 21, pp. 2634-2636.

J.W. Frame et al., Jul. 23, 1998, "Planar microdischarge arrays", Electronics Letters, vol. 34, No. 15, pp. 1529-1531.

Karl H. Schoenbach et al, Jun. 30, 1997, "High-pressure hollow cathode discharges;"; Plasma Sources Sci Technical., pp. 468-477.

A. El-Habachi, et al, Jan. 5, 1998, "Emission of excimer radiation from direct current, high-pressure hollow cathode discharges;"; App. Phys. Lett. 72 (1), pp. 22-24.

S. J. Park et al., Jan. 2001, "Performance of microdischarge devices and arrays with screen electrodes," IEEE Photon, Tech. Lett., vol. 13, pp. 61-63.

C. J. Wagner, et al., Feb. 12, 2001, "Excitation of a microdischarge with a reverse-biased pn junction," Appl. Phys. Lett., vol. 78, pp. 709-711.

S. J. Park et al., Sep. 24, 2001, "Independently addressable subarrays of silicon microdischarge devices: Electrical characteristics of large (30 +30) arrays and excitation of a phosphor," Appl. Phys. Lett., vol. 79, pp. 2100-2102.

B.A. Voyak, et al., Mar. 5, 2001, "Multistage, monolithic ceramic microdischarge device having an active length of -0.27 mm," Appl. Phys. Lett., vol. 78, No. 10, pp. 1340-1342.

R. H. Stark et al., Feb. 15, 1999, "Direct current high-pressure glow dischrages",J. Appl. Phys. vol. 85, pp. 2075-2080.

J.F. Waymouth, Dec. 1991, "LTE and Near-LTE Lighting Plasmas", IEEE Transaction on Plasma Science, Vo. 19 No. 6 pp. 1003-1012.

A.D. White, May 1959, "New Hollow Cathode Glow Discharge", Journal of Applied Physics, vol. 30, No. 5, pp. 711-719.

L.C. Pitchford, et al., Jul. 1997, "The breakdown and glow phases during the initiation of discharges for lamps", J. Appl. Phys. 82, (1) pp. 112-119.

S. J. Park et al., Feb. 1, 2001, "Arrays of microdischarge devices having 50-100um square pyramidal Si anodes and screen cathodes," 1 Electron. Lett. vol. 37 No. 3, pp. 171-172.

J.G. Eden et al., Nov. 2003, "Microplasma devices fabricated in silicon, ceramic, and metal/polymer structures: arrays, emitters and photodetectors," Journal of Physics D: Applied Physics 36, pp. 2869-2877.

S. J. Park et al., May 31, 2004, "Carbon nanotube-enhanced performance of microplasma devices," Applied Physics Letters, pp. 4481-4483, vol. 84, No. 22.

H. Masuda: et al., Jun. 9, 1995, "Ordered Metal Nanohole Arrays Made by a Two-Step Replication of Honeycomb Structures of Anodic Alumina", Science, New Series, vol. 268, No. 5216, 1466-1468.

O. Jessensky et al., Mar. 9, 1998, "Self-organized formation of hexagonal pore arrays in anodic alumina", Applied Physics Letters, vol. 72 No. 10., 1173-1175.

R. H. Stark et al., Jun. 21, 1999, "Direct current glow discharges in atmospheric air," Appl. Phys. Lett., vol. 74, pp. 3770-3772.

S.-J. Park et al., Jan. 22, 2001, "Silicon microdischarge devices having inverted pyramidal cathodes: Fabrication and performance of arrays," Appl. Phys. Lett., vol. 78, pp. 419-421.

A.-A. H. Mohamed, et al., Feb. 2002, "Direct current glow discharges in atmospheric air," IEEE Trans. Plasma Sci., vol. 30, pp. 182-183.

ARRAYS OF MICROCAVITY PLASMA DEVICES WITH DIELECTRIC ENCAPSULATED ELECTRODES

PRIORITY CLAIM AND REFERENCE TO RELATED APPLICATION

This application claims priority under 35 U.S.C. §119 from provisional application Ser. 60/699,475, filed Jul. 15, 2005, is a continuation-in-part of and claims priority under 35 U.S.C. §120 from U.S. application Ser. No. 10/958,174, filed Oct. 4, 2004, now U.S. Pat. No. 7,297,041 and is a continuation-in-part of and claims priority under U.S.C. §120 of U.S. application Ser. No. 10/958,175, filed Oct. 4, 2004 entitled "Metal/Dielectric Multilayer Microdischarge Devices and Arrays".

STATEMENT OF GOVERNMENT INTEREST

This invention was made with Government assistance under U.S. Air Force Office of Scientific Research grant No. F49620-03-1-0391. The Government has certain rights in this invention.

FIELD OF THE INVENTION

The invention is in the field of microcavity plasma devices, also known as microdischarge devices or microplasma devices.

BACKGROUND

Microcavity plasma devices have several distinct advantages over conventional discharges. The small physical dimensions of microcavity plasma devices allows them to operate at pressures much higher than those accessible to conventional, macroscopic discharges. When the diameter of a cylindrical microcavity plasma device is, for example, on the order of 200-300 μm or less, the device will operate at pressures as high as atmospheric pressure and beyond. In contrast, standard fluorescent lamps, for example, operate at pressures typically less than 1% of atmospheric pressure. Microcavity plasma devices may be operated with different discharge media (gases or vapors or a mixture thereof) to offer output in the visible and nonvisible (ultraviolet, vacuum ultraviolet, and infrared, for example) wavelength ranges. Microcavity plasma devices are able to produce light more efficiently than other conventional discharge systems and do so on the microscopic scale.

Microcavity plasma devices developed over the past decade have been demonstrated to be well-suited for a wide variety of applications. An exemplary application for a microcavity plasma device array is to a display. Since the diameter of single cylindrical microcavity plasma devices, for example, is typically less than 400-500 μm, devices or groups of devices offer a spatial resolution that is desirable for a pixel in a display. In addition, the efficiency of a microcavity plasma device exceeds that of a conventional plasma display panel, such as those used in high definition televisions.

Early microcavity plasma devices exhibited short lifetimes because of sputtering that damaged metal electrodes used in the early, DC-driven devices. Polycrystalline silicon and tungsten electrodes extend lifetime but are higher cost materials and difficult to fabricate with present techniques.

Research by the present inventors and colleagues at the University of Illinois has pioneered and advanced the state of microdischarge devices. This development has led to practical devices including one or more important features and structures. For example, microcavity plasma devices can be operated continuously at gas pressures beyond one atmosphere at power loadings exceeding 100 kW/cm$^3$. The ability to interface plasma in the gas or vapor phase with an e-h+ plasma in semiconductor devices has been demonstrated. MEMs and semiconductor processes have been applied to the fabrication of devices and arrays.

This research by present inventors and colleagues at the University of Illinois has resulted in exemplary practical devices. For example, semiconductor fabrication processes have produced exemplary densely-packed arrays of uniform microcavity plasma devices. An example array fabricated in silicon has demonstrated 250,000 discharge devices in a 25 cm$^2$ active area. It has been demonstrated that the arrays can be used to excite phosphors in a manner analogous to plasma display panels, but at luminous efficacy levels that are not achievable with conventional plasma display panels. Another important device is a microcavity plasma photodetector that exhibits high sensitivity. Phase locking of microcavity plasma devices has also been demonstrated. Devices have been fabricated in ceramic material systems.

The following U.S. patents and patent applications describe microcavity plasma devices resulting from these research efforts. Published Applications: 20050148270—Microdischarge devices and arrays; 20040160162—Microdischarge devices and arrays; 20040100194—Microdischarge photodetectors; 20030132693—Microdischarge devices and arrays having tapered microcavities; U.S. Pat. No. 6,867,548—Microdischarge devices and arrays; U.S. Pat. No. 6,828,730—Microdischarge photodetectors; U.S. Pat. No. 6,815,891—Method and apparatus for exciting a microdischarge; U.S. Pat. No. 6,695,664—Microdischarge devices and arrays; U.S. Pat. No. 6,563,257—Multilayer ceramic microdischarge device; U.S. Pat. No. 6,541,915—High pressure arc lamp assisted start up device and method; U.S. Pat. No. 6,194,833—Microdischarge lamp and array; U.S. Pat. No. 6,139,384—Microdischarge lamp formation process; and U.S. Pat. No. 6,016,027—Microdischarge lamp.

U.S. Pat. No. 6,541,915 discloses arrays of microcavity plasma devices in which the individual devices are fabricated in an assembly that is machined from materials including ceramics. Metallic electrodes are exposed to the plasma medium which is generated within a microcavity and between the electrodes. U.S. Pat. No. 6,194,833 also discloses arrays of microcavity plasma devices, including arrays for which the substrate is ceramic and a silicon or metal film is formed on it. Electrodes formed at the tops and bottoms of cavities, as well as the silicon, ceramic or glass microcavities themselves, contact the plasma medium. U.S. Published Patent Application 2003/0230983 discloses microcavity plasma devices produced in low temperature ceramic structures. The stacked ceramic layers are arranged and micromachined so as to form cavities and intervening conductor layers excite the plasma medium. U.S. Published Patent Application 2002/0036461 discloses hollow cathode plasma devices in which electrodes contact the plasma/discharge medium.

Additional exemplary microcavity plasma devices are disclosed in U.S. Published Patent Application 2005/0269953, entitled "Phase Locked Microdischarge Array and AC, RF, or Pulse Excited Microdischarge"; U.S. Published Patent Application No. 2006/0038490, entitled "Microplasma Devices Excited by Interdigitated Electrodes;" U.S. patent application Ser. No. 10/958,174, filed on Oct. 4, 2004, entitled "Microdischarge Devices with Encapsulated Electrodes,"; U.S. patent application Ser. No. 10/958,175, filed on Oct. 4, 2004, entitled "Metal/Dielectric Multilayer Microdischarge Devices and Arrays"; and U.S. patent application Ser. No. 11/042,228, entitled "AC-Excited Microcavity Discharge Device and Method."

SUMMARY OF THE INVENTION

The invention concerns microcavity plasma devices and arrays with thin foil metal electrodes protected by metal oxide dielectric. Devices of the invention are amenable to mass production techniques, and may, for example, be fabricated by roll to roll processing. Exemplary devices of the invention are flexible. Embodiments of the invention provide for large arrays of microcavity plasma devices that can be made inexpensively.

The structure and materials of preferred embodiment microcavity plasma devices of the invention allow for arrays of arbitrary large size to be realized. Devices of the invention are based upon thin foils of metal that are available or can be produced in arbitrary lengths, such as on rolls. In a device of the invention, a metal foil with a pattern of microcavities defines an electrode pattern. Oxide on the surface of the foil and within the microcavities encapsulates the foil. The oxide protects the foil from the plasma during device operation and largely confines the plasma to the microcavities.

A second metal foil is also encapsulated with oxide and is bonded to the first encapsulated foil. For preferred embodiment microcavity plasma device arrays of the invention, no particular alignment is necessary during bonding of the two encapsulated foils. A thin glass layer, for example, is able to vacuum seal the array.

In a formation method of the invention, a pattern of microcavities is produced in a first metal foil. Oxide is subsequently grown on the foil, including on the inside walls of the microcavities (where plasma is to be produced). The oxide protects the microcavity and electrically isolates the foil. A second encapsulated metal foil is then bonded to the second metal foil and the entire array can be produced by roll-to-roll processing.

DETAILED DESCRIPTION OF THE PREFERRED EMBODIMENTS

Figure 1A:
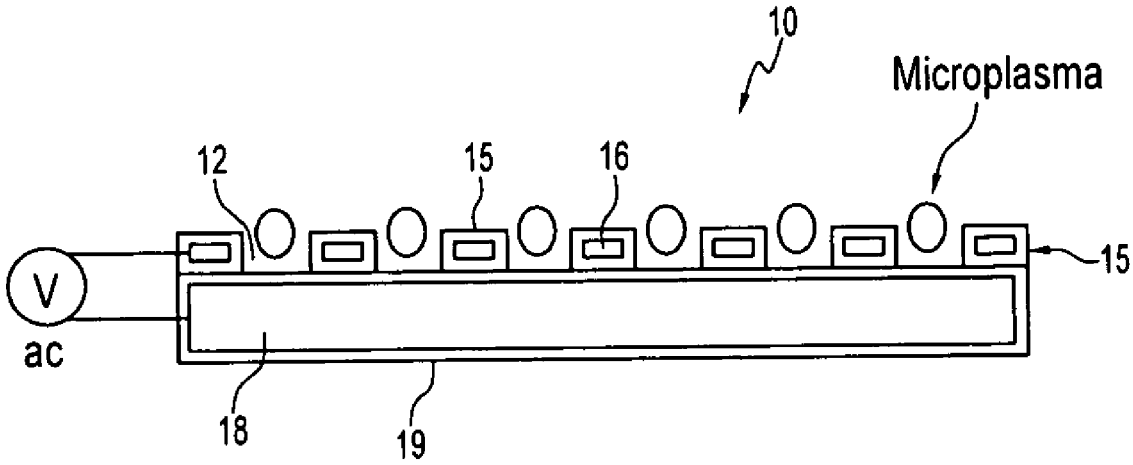
FIG. 1A is a schematic cross-section of an exemplary embodiment microcavity plasma device array of the invention.

The invention concerns microcavity plasma devices and arrays of devices in which thin foil metal electrodes are protected by a metal oxide dielectric. Devices of the invention are amenable to mass production techniques, and may, for example, be fabricated by roll to roll processing. Exemplary devices of the invention are flexible. Embodiments of the invention provide for large arrays of microcavity plasma devices that can be made inexpensively.

The structure of preferred embodiment microcavity plasma devices of the invention is based upon thin foils of metal that are available or can be produced in arbitrary lengths, such as on rolls. In a device of the invention, a pattern of microcavities is produced in a metal foil. Oxide is subsequently grown on the foil, including within the microcavities, to define oxide encapsulated microcavities (in which the plasma is to be produced). The oxide protects the microcavity and electrically isolates the foil, which forms a first electrode.

A second metal foil, without microcavities in a preferred embodiment, is also encapsulated with oxide and is bonded to the first encapsulated foil. The second metal foil forms a second electrode. For preferred embodiment microcavity plasma device arrays of the invention, no particular alignment is necessary during bonding of the two encapsulated foils. A thin glass layer, for example, is able to seal the completed array.

In a preferred embodiment method of making a microcavity plasma array, two foils of Al, both of which are encapsulated with $Al_2O_3$, are bonded to one another. Only one of the two encapsulated foils has microcavities (with a characteristic dimension d on the micron scale). For a cylindrical microcavity, for example, the characteristic dimension would be its diameter. These microcavities can assume a wide variety of shapes and may or may not extend completely through the encapsulated metal foil. Experiments have been conducted to demonstrate the invention with diamond-shaped and cylindrical microcavities. High densities of microcavity plasma devices are possible, and an exemplary experimental "filling factor" (ratio of the array's radiating area to the overall area) of extraordinary levels (>80%) have been achieved. The shape (cross-sectional geometry and depth) of the microcavity, as well as the identity of the gas or vapor in the microcavity, determine the plasma configuration and the radiative efficiency for a specific atomic or molecular emitter. Overall thickness of exemplary microplasma array structures of the invention can be, for example, 200 μm or less, making it very flexible and inexpensive.

In example embodiment microcavity plasma device arrays of the invention, two electrodes simultaneously excite all microcavity plasma devices in the array. The second electrode can be a simple foil electrode, and there is no need to precisely align this electrode with the first electrode during fabrication. In other example embodiment microcavity plasma device arrays of the invention, a plurality of second electrode foils are matched with different sections of a larger first electrode having a plurality of microcavities. In this way, excitation of separate sections of the microplasma device array is realized. Depending upon the size of the second electrode foils and the spacing between the second electrode foils, alignment considerations during manufacturing can also be permissive.

Other embodiments of the invention provide independent addressing of microcavity plasma devices in an array. For example, electrode lines can be formed in both a first screen electrode and a second foil electrode by selective oxidation with simple masking or photolithographic methods. After the selective oxidation, a second oxidation to encapsulate the electrode is performed, thereby sealing the electrode.

Preferred embodiments will now be discussed with respect to the drawings. The drawings include schematic figures that are not to scale, which will be fully understood by skilled artisans with reference to the accompanying description. Features may be exaggerated for purposes of illustration. From the preferred embodiments, artisans will recognize broader aspects of the invention.

FIG. 1A is a cross-sectional diagram of an example embodiment microcavity plasma device array 10. Microcavities 12 are defined in a metal foil that constitutes a first electrode 16. Oxide 15 encapsulates the metal foil including the walls of the microcavities 12. The first electrode 16 in the microcavity plasma device array 10 is a thin conductive foil into which a pattern of microcavities has been formed by any of a variety of techniques, including, for example, microdrilling, mechanical punching, laser ablation, or chemical etching. Encapsulation of the thin conductive foil and its microcavities 12 (which may or may not extend completely through the foil) protects the metal 16 because the walls of the microcavities and the surface of the conductive foil are coated with oxide 15. The oxide 15 protects the first electrode 16 from sputtering during operation, thereby promoting the lifetime of the array 10, and electrically insulating electrode 16 as well.

The nominal depth of the microcavities 12 approximates the thickness of the first electrode 16, although it is not necessary for the microcavities to extend through the metal foil 16. A second electrode 18 can be a solid thin conductive foil. The second electrode 18 is also encapsulated in oxide 19. A discharge medium (gas, vapor, or a combination thereof) is contained in the microcavities. The array 10 can be sealed by any suitable material, which can be completely transparent to emission wavelengths produced by the microplasmas or can, for example, filter the output wavelengths of the microcavity plasma device array 10 so as to transmit radiation only in specific spectral regions.

It is within each microcavity 12 that a plasma (discharge) will be formed. The first and second electrodes 16, 18 are spaced apart a distance from the microcavities 12 by at least the respective thicknesses of their oxide layers. The oxide thereby isolates the first and second electrodes 16, 18 from the discharge medium (plasma) contained in the microcavities 12. This arrangement permits the application of a time-varying (AC, RF, bipolar or pulsed DC, etc.) potential between the electrodes 16, 18 to excite the gaseous or vapor medium to create a microplasma in each microcavity 12.

Representative conductive materials for the electrodes 16, 18 and the oxides 15, 19 include metal/metal oxide materials, e.g., $Al/Al_2O_3$. Another exemplary metal/metal oxide material system is $Ti/TiO_2$. Other conductive material/oxide material systems will be apparent to artisans. Preferred materials systems permit the formation of microcavity plasma device arrays of the invention by inexpensive, mass production techniques, such as roll to roll processing.

A preferred method of manufacturing is roll-to-roll processing. In the preferred method, the first electrode 16 is pre-formed with microcavities having the desired cross-sectional geometry. Suitable metal foils, e.g. Al foils, with microcavities in the form of through holes of various cross-sectional geometries are also available commercially, as they find use, for example, in the battery industry. A pre-formed screen-like metal foil, e.g. Al, with microcavities and encapsulated with oxide defines an electrode pattern, and can be bonded to another oxide encapsulated metal foil, e.g. Al. The second foil can be a solid foil. In the preferred method of manufacturing, no precise alignment is necessary between the two metal foils during the bonding process. Accordingly, the oxide encapsulated foils that form the first electrode 16 and the second electrode 18 in the completed device can be bonded together without any alignment concerns. Roll-to-roll processing can be used. Although it is possible to fabricate microcavities in $Al_2O_3$ covered Al foil (see, e.g., U.S. application Ser. No. 10/958,174, filed Oct. 4, 2004 entitled "Microdischarge Devices with Encapsulated Electrodes," and U.S. application Ser. No. 10/958,175, filed Oct. 4, 2004 entitled "Metal/Dielectric Multilayer Microdischarge Devices and Arrays," both of which are incorporated by reference herein), it is preferable to provide Al (or other conductive thin foil material) with microcavities already present and then encapsulate the conductive thin foil with oxide to form an oxide encapsulated electrode with an array of encapsulated microcavities. Providing a conductive thin foil with microcavities includes either fabricating the cavities in conductive foil by any of a variety of processes (laser ablation, chemical etching, etc.) or obtaining a conductive thin foil with pre-fabricated microcavities from a supplier. A wide variety of microcavity shapes (cross-sectional geometries) can be formed in conductive foils.

Prototype devices in accordance with the array 10 of FIG. 1A have been fabricated. An example experimental prototype array had a first electrode that was formed from a thin metal Al foil with generally diamond-shaped microcavities extending through the foil. Growth of a porous $Al_2O_3$ film onto the first metal foil having the microcavities was accomplished by a multi-step wet chemical process in which the Al is first anodized in a 0.1-0.3 M oxalic acid solution at nominally 15° C. After removing most of the oxide in a chromic acid/phosphoric acid solution, a second anodization process grows the highly-ordered nanoporous $Al_2O_3$ film in which the nanopore dimensions and spacing can be controlled. In the experiments, the final thickness of the $Al_2O_3$ nanoporous film was typically in the 5-30 μm range. Generally, the $Al_2O_3$ film thickness within the microcavities was maintained at 5-20 μm thinner than the oxide film covering the surface of the foil. The first electrode (having the microcavity array) is subsequently bonded to a second encapsulated electrode. The second electrode was another thin metal foil with no cavities, onto which an anodic $Al_2O_3$ film was grown. Since the second electrode has no microcavities, precise alignment of the first and second electrodes during the bonding process is not necessary, thereby simplifying the overall fabrication process. The example experimental array was operated with Ne gas, at pressures ranging from 400 Torr to 800 Torr, as well as with Ne/Xe gas mixtures. After bonding the two encapsulated electrodes together, the array can be sealed between two thin sheets of glass, if array rigidity is acceptable for the envisioned application, by one of several processes such as anodic bonding or glass frit. If array flexibility is desired, the array can be sealed between thin sheets of plastic such as those commonly used to seal food. A thin film of a material such as $SiO_2$ can be deposited onto the inner surface of the polymer sealing film in order to minimize outgassing of the polymer into the plasma which reduces gas lifetime. Regardless of the sealing method, it is possible to seal the array in the presence of the desired gas or gas/vapor mixture (thereby sealing the gas in the array) or to fill the array with gas after the entire device is fabricated and evacuated. The latter technique can be accomplished with a small diameter tube connecting the array with a gas handling/vacuum system, which enables the array to be evacuated and then back-filled with the desired gas.

Optical micrographs of an exemplary array operating in Ne gas at a pressure of 400 Torr showed the thickness of the $Al_2O_3$ film on the first electrode 16 was 10 μm and that on the second electrode 18 was also 10 μm. The micrograph was obtained with a CCD camera and an optical telescope looking down onto the array with electrode one on top. As observed in the microphotograph, the diamond shaped microcavities have a length (tip to tip) of 500 μm and a width of 250 μm and, for these operating conditions, the plasma is observed to reside near the center of each microcavity. The structure of the microplasma arrays of this embodiment lead to a strong axial electric field (axial denotes the direction orthogonal to the plane of the microcavity "diamond" opening, and at the center of the "diamond").

Figure 1B:
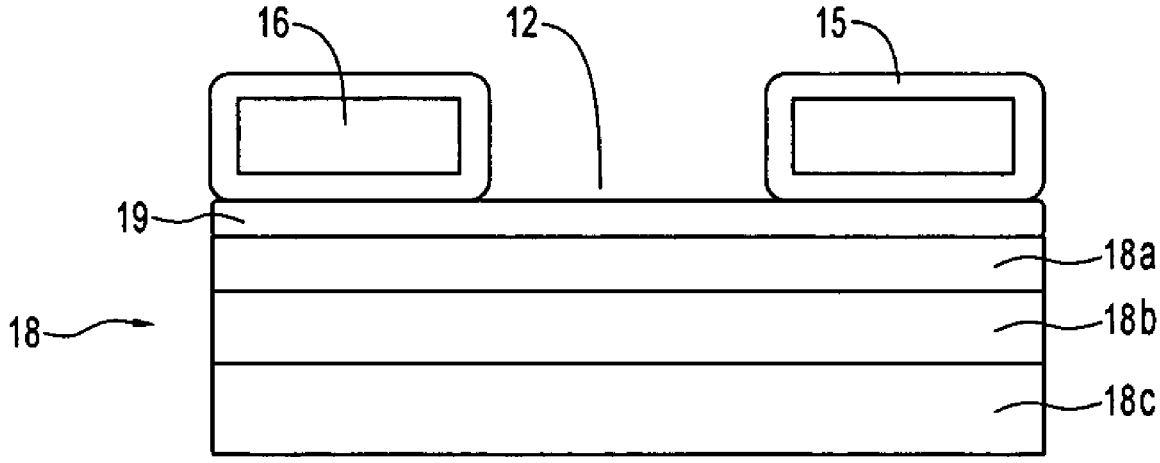
FIG. 1B is a schematic cross-section of an exemplary embodiment microcavity plasma device array of the invention.

FIG. 1B is a cross-sectional diagram of another example embodiment microcavity plasma device, representing a device in an array. Reference numerals from FIG. 1A are used to identify comparable parts in the FIG. 1B device. The FIG. 1B device is similar to the devices forming the FIG. 1A array, but the second electrode has a modified structure. Having a basic concept of capacitor, the second electrode 18 includes three layers, two conductive layers 18*a* and 18*b* surrounding a dielectric layer 18*c*. The dielectric layer 18*c* can be $Al_2O_3$, for example, and the conductive layers Al, for example. The thickness of dielectric layer 18*c* can be selected according to the capacitance required for the particular application. The dielectric layer 18*c* can be few to hundreds of μm thick.

Figure 2:
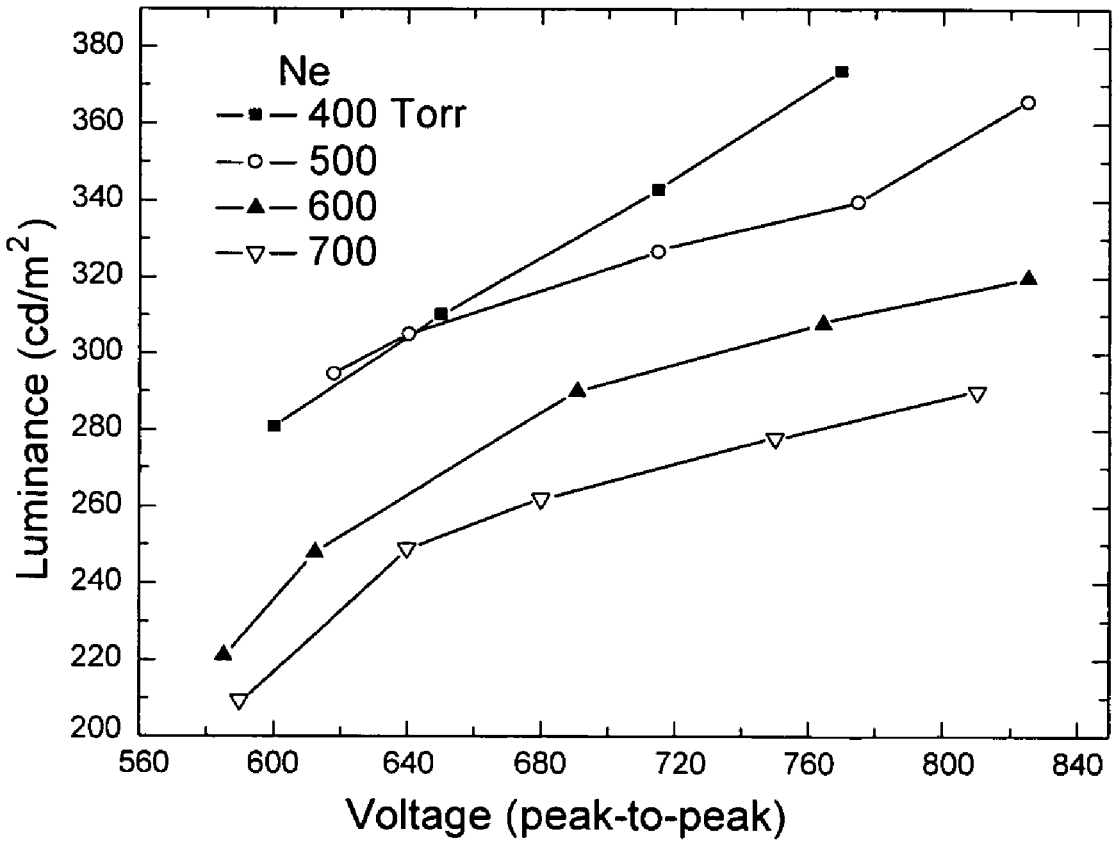
FIG. 2 plots luminance as a function of excitation voltage for an example experimental prototype microcavity plasma device array operated in neon at pressures of 400 Torr, 500 Torr, 600 Torr and 700 Torr.

FIG. 2 plots luminance as a function of excitation voltage for an example experimental prototype microcavity plasma device array operated in neon at pressures of 400 Torr, 500 Torr, 600 Torr and 700 Torr. At all of the pressures, luminance generally increased as a function of voltage and emission was strongest at 400 Torr because of the size of the diamond-shaped microcavities. For smaller microcavities the peak emission will be observed at higher gas pressures.

Figure 3:
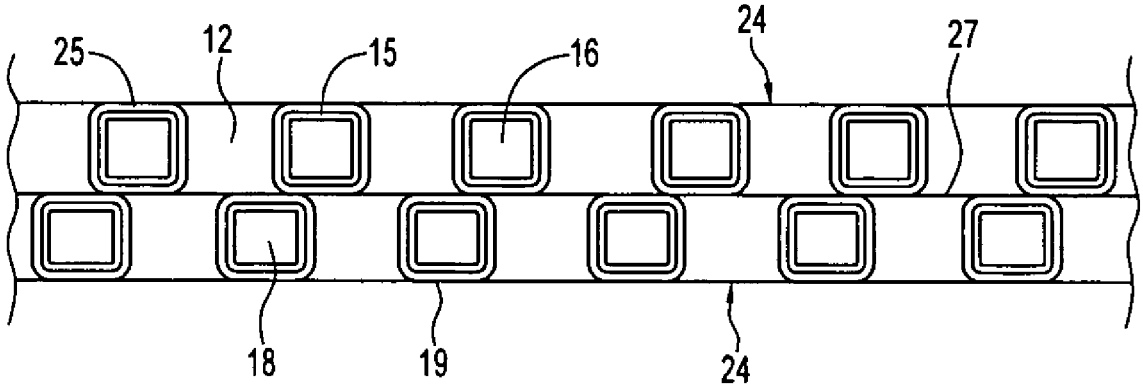
FIG. 3 is a schematic cross-section of another exemplary embodiment microcavity plasma device array of the invention.

FIG. 3 is a cross-sectional diagram of a portion of another example embodiment microcavity plasma device array 22. The device array 22 is similar to the array 10 of FIG. 1A. Reference numbers from FIG. 1A are used to label comparable parts of the microcavity plasma device array. In this device 22, the second electrode(s) 18 is patterned with microcavities having the same or different cavity dimensions as those in the first electrode(s) 16. The array 22 is sealed with a thin glass or plastic layer 24. Whether glass or plastic is used, the total thickness of the array can be small enough to permit the array to be flexible. In example embodiments, the total thickness of an array in accordance with the array 22 of FIG. 3 or the array 10 of FIG. 1 can be less than ~100 μm and whole device is flexible. FIG. 3 also illustrates an additional thin film of dielectric 25 deposited upon the oxide 15 and 19. In preferred embodiments, the additional dielectric thin film 25 is glass. It has been found that, after the nanoporous oxide films 15, 19 are grown, a final film of glass deposited onto the screen improves the lifetime and performance of an electrode. This glass layer can be deposited from solution by a standard dipping process.

Figure 4:
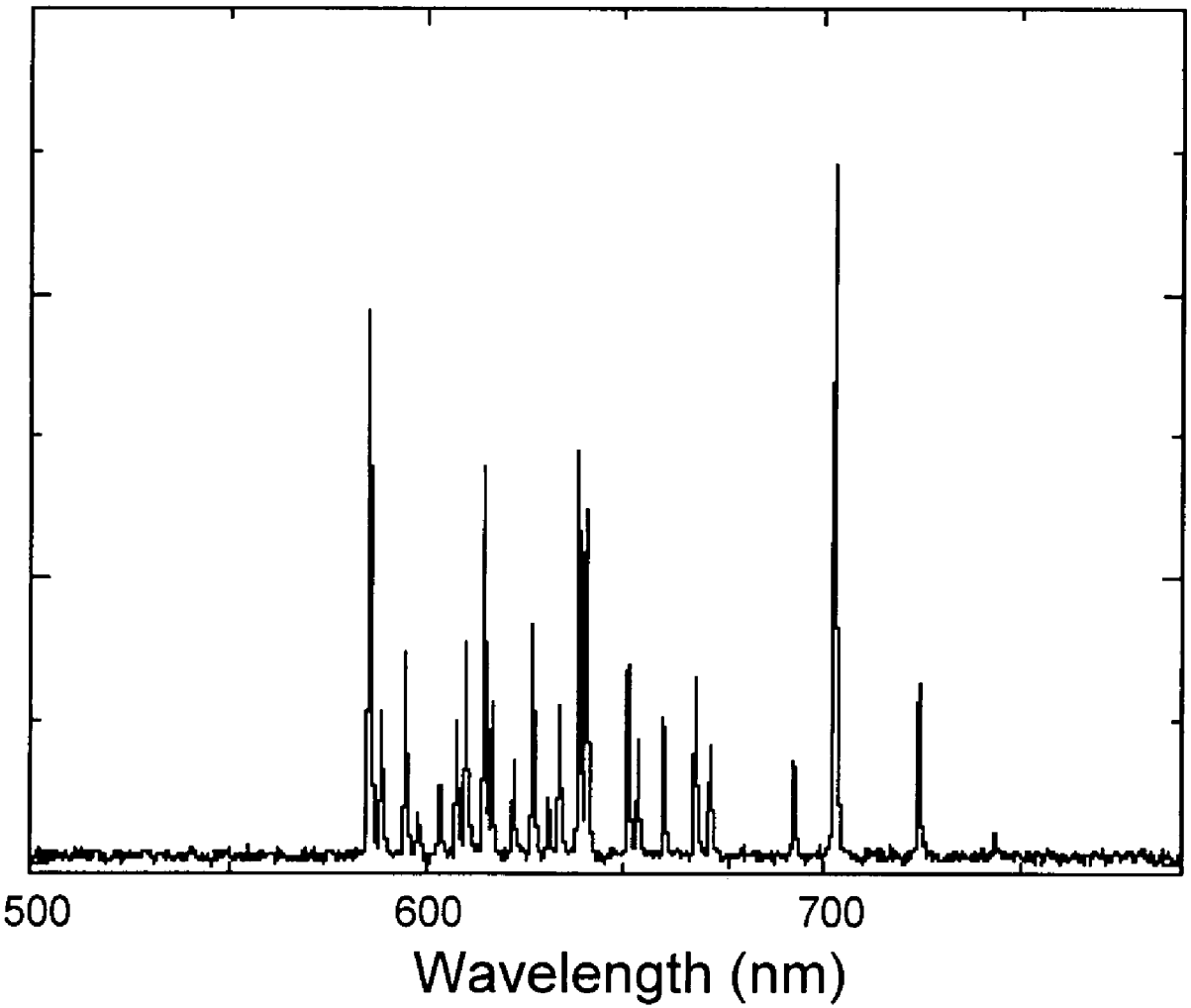
FIG. 4 shows the discharge spectrum of an example experimental prototype 10×10 microcavity plasma device array operated in neon at 700 Torr.
Figure 5:
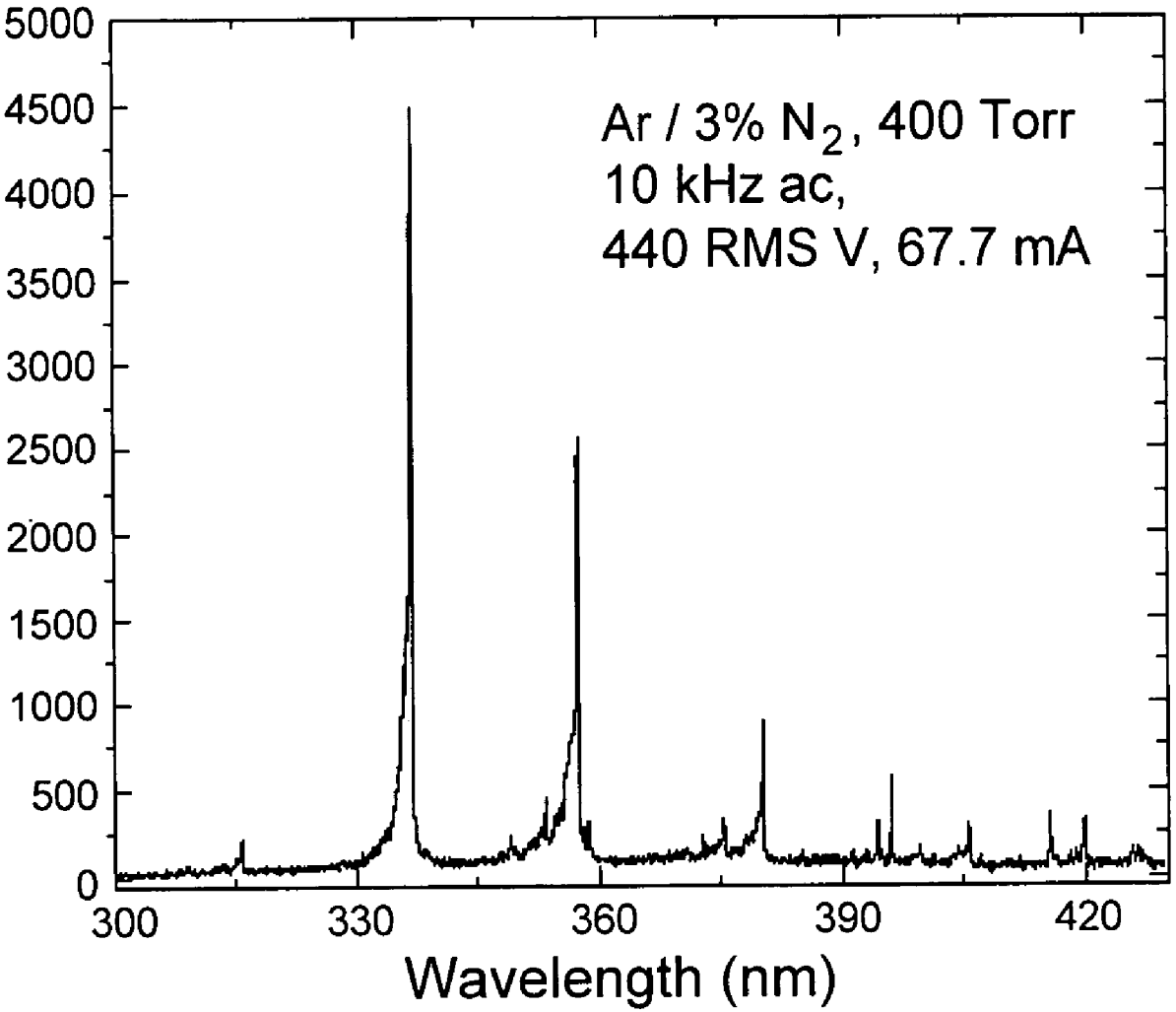
FIG. 5 shows the spectrum in the near-ultraviolet produced by a prototype 5×5 microcavity plasma device array operated in a mixture of argon and $N_2$ at a total pressure of 400 Torr and excited by a 10 kHz ac waveform with an RMS voltage of 440 V.

FIG. 4 shows the discharge spectrum in the visible of an example experimental prototype 10×10 microcavity plasma device array operated in neon at 700 Torr. Emission in the 500-800 nm wavelength interval is shown because this is the region in which the most intense emission is observed. However, emission at a wide variety of other wavelengths is obtainable by introducing other gases and gas mixtures into the array. As a second example, FIG. 5 shows the emission spectrum produced in the near-ultraviolet by an example experimental prototype 5×5 microcavity plasma device array operated in an argon/nitrogen gas mixture at a total pressure of 400 Torr. The driving voltage for the array was a 10 kHz sinusoidal AC waveform having a voltage of 440 V RMS. The current drawn by the array was ~68 mA. Other examples of wavelengths available from these arrays include 308 nm (from the OH radical), 193, 248, 308, 351, 222, and 282 nm from various rare gas-halide molecules, continua in the 250-400 nm region from $H_2$ or $D_2$, and 206 nm from atomic iodine. Numerous other radiation wavelengths are available from other species.

Figure 6:
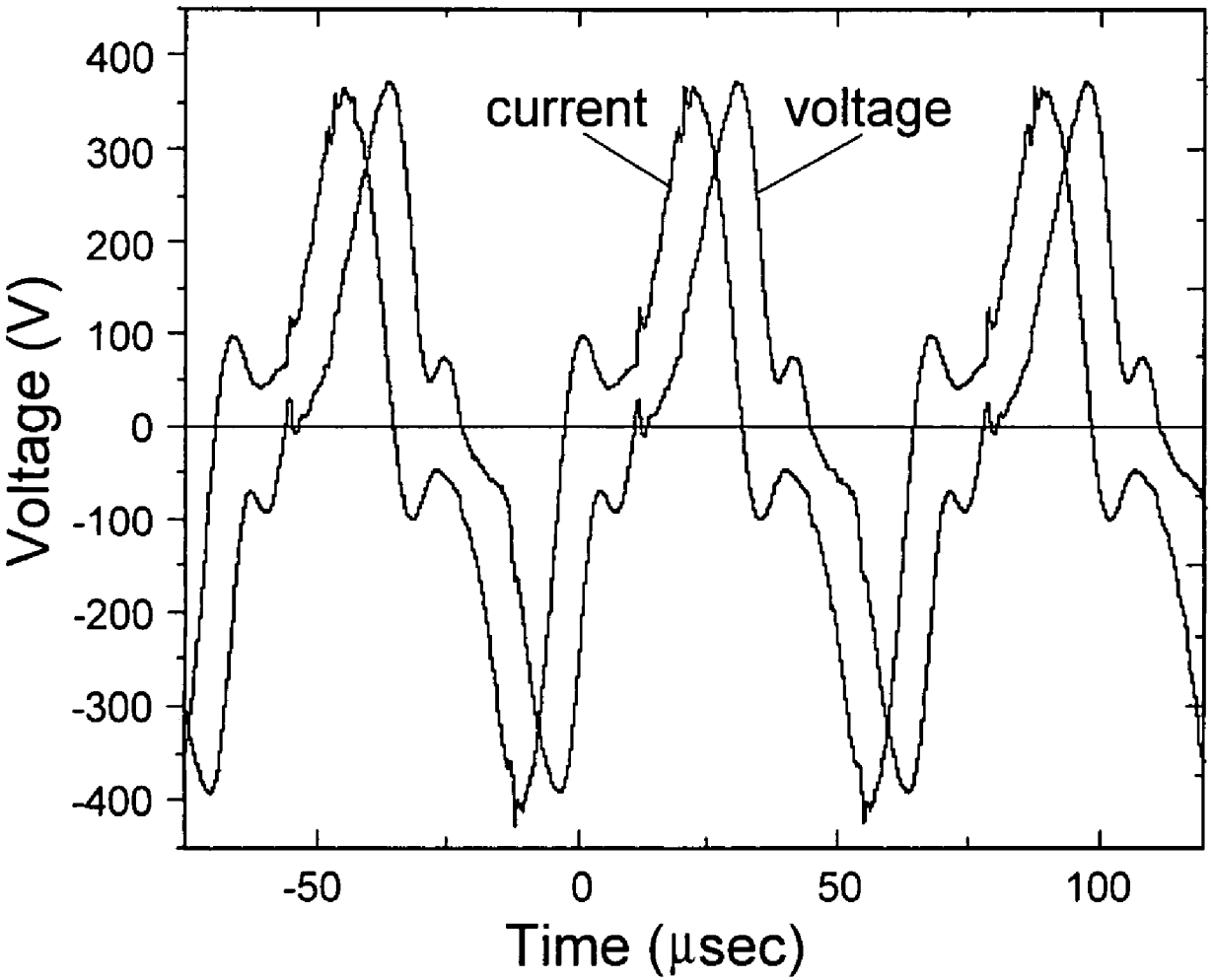
FIG. 6 shows the voltage and current waveforms for an experimental embodiment large scale, flexible $Al_2O_3$/Al microcavity plasma device array.

FIG. 6 shows the voltage and current waveforms for an example experimental prototype large scale, $Al_2O_3$/Al microcavity plasma device array. The array comprised ~4,800 devices with microcavities having the 500 μm long, 250 μm wide diamond cross-section and these waveforms were obtained for operation in 700 Torr of Ne. The I-V characteristics associated with the waveforms of FIG. 6 are those typical of a dielectric barrier discharge in which the plasma is generated by the capacitive mode.

Figure 7:
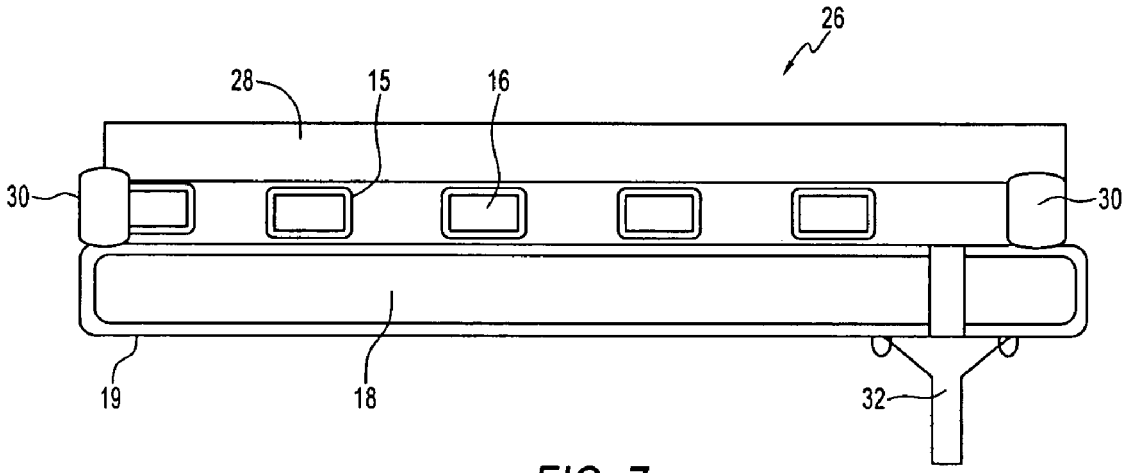
FIG. 7 shows a cross-sectional diagram of an example embodiment flat lamp incorporating a microcavity plasma device array.

FIG. 7 shows an example of a vacuum sealed flat lamp embodiment 26 of the invention. The device 26 is similar to the FIG. 1 device and reference numbers from FIG. 1 are used to label comparable parts in FIG. 7. The lamp 26 uses a window 28 of glass or plastic and an unpatterned second electrode 18. The device 26 is generally not flexible but only because of the normal thickness of the quartz window (≧1 mm). However the thickness of the lamp (minus the window thickness) is only 170 μm and therefore the lamp will be flexible if the window 28 itself is flexible. Sealing material 30 ensures that the device is vacuum tight, and a evacuation tube 32 is shown, but can be removed or sealed as part of the manufacturing process. Different materials can be used for the window 28 to achieve the desired spectral transmission or filtering and provide a specific desired wavelength of emission. As discussed earlier, it may be advantageous for array lifetime to, in addition to the $Al_2O_3$ layers 15 and 19, encapsulate the Al electrodes 16 and 18 with a thin layer of glass (additional layer not shown in FIG. 7 for second electrode 18).

Figure 8:
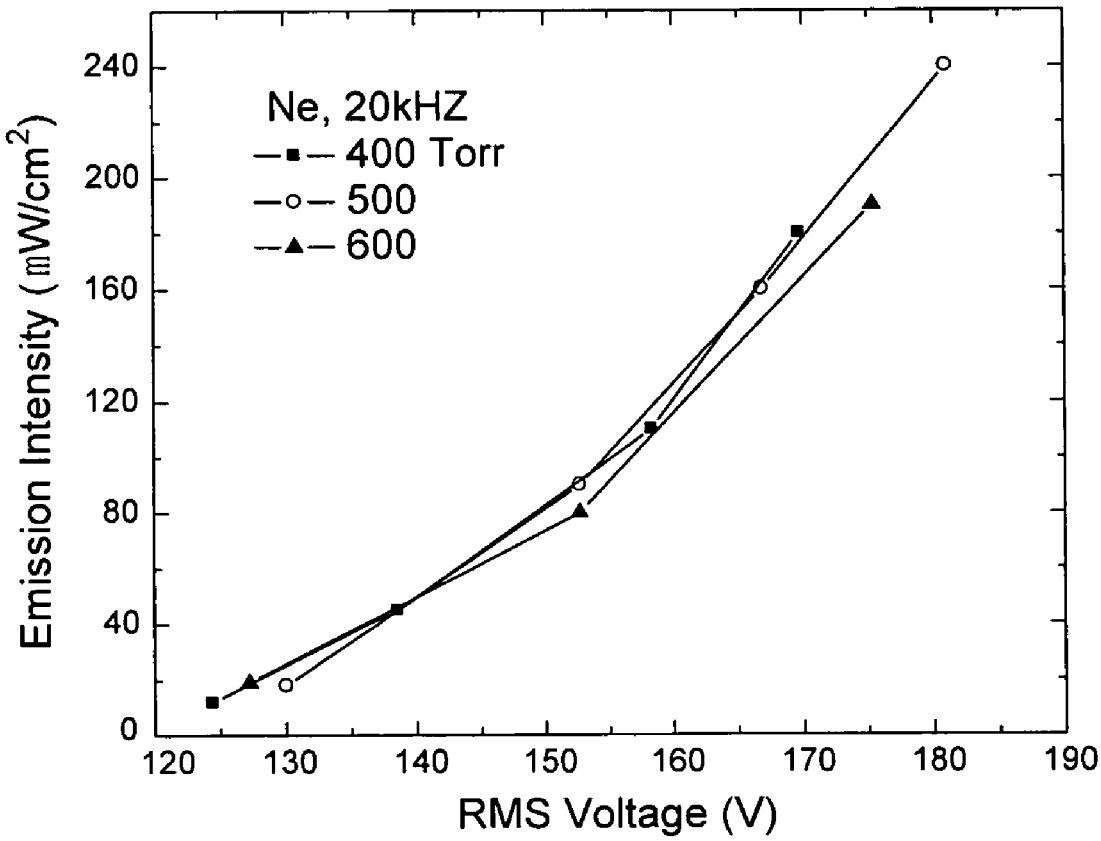
FIG. 8 shows the dependence of emission intensity on RMS driving voltage for an experimental embodiment $Al_2O_3$/Al lamp including a microcavity plasma device array (according to FIG. 7) operating in 400-600 Torr of Ne.

An experimental device in accordance with FIG. 7 was constructed with aluminum encapsulated in 10 μm of $Al_2O_3$ and 5 μm of glass encapsulation. FIG. 8 shows the dependence of emission intensity on the RMS driving voltage for the $Al_2O_3$/Al microcavity plasma array operating in 400-600 Torr of Ne. Emission intensity increased steeply as applied voltage increased.

Figure 9:
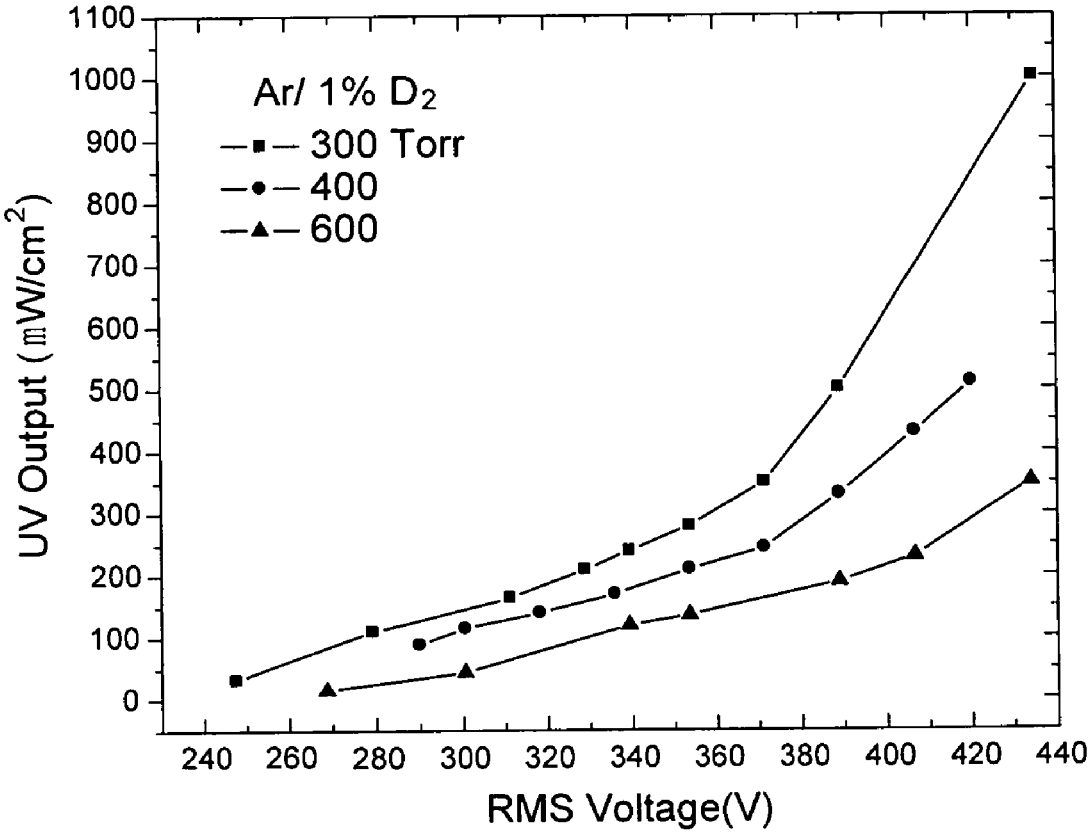
FIG. 9 shows the dependence of UV emission intensity on RMS driving voltage for an experimental embodiment $Al_2O_3$/Al lamp incorporating a microcavity plasma device array (according to FIG. 7) operating in 300, 400 and 600 Torr of an Ar/1% $D_2$ gas mixture.

FIG. 9 shows the ultraviolet (UV) emission intensity from a 2" square experimental vacuum sealed flat lamp in accordance with FIG. 7, and operating with a gas mixture of 1% $D_2$ in Ar. As with the Ne emissions shown in FIG. 8, the emission rises as the voltage is increased and intensities up to 1 mW/cm$^2$ are achieved. It must be emphasized that 1 mW/cm$^2$ does not represent the maximum value of output of the experimental embodiment lamp according to FIG. 7. Instead, this output is the highest value obtained to date in the test voltage range. The FIG. 9 data were obtained with Ar/1% $D_2$ gas mixtures pressures between 300 and 600 Torr and the resulting emission from the microplasma lies in the 250-400 nm range.

Figure 10:
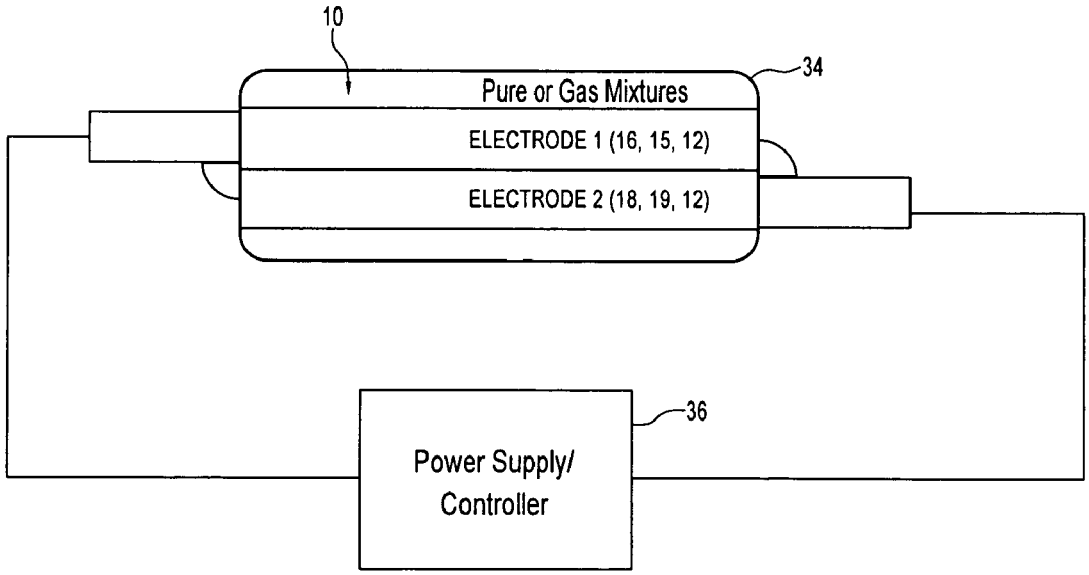
FIG. 10 shows a cross-sectional diagram of an example embodiment flexible lamp incorporating a microcavity plasma device array.

FIG. 10 shows another embodiment lamp incorporating a microcavity plasma device array. FIG. 10 also illustrates an experimental arrangement for testing the lamp. In the FIG. 10 device, first and second electrodes 16, 18 (one or both of which have microcavities 12), for example according to FIGS. 1 or 3, are pre-formed metal foil screens that are then encapsulated in oxide to form a microcavity plasma device array 10, which can be sufficiently thin (less than or on the order of a few hundred micrometers) to be flexible. The two encapsulated electrodes 16, 18 (one or both of which are screens) are generally bonded to each other with a polymeric adhesive although bonding is not necessary. To maintain a high level of flexibility after vacuum sealing, the array 10 is packaged in polymeric vacuum packaging 34. Extensions of the electrodes 16, 18 extend beyond the packaging 34 in an experimental embodiment for connection to a power supply/controller 36. Vacuum sealing in polymeric packaging is possible because the microcavity plasma device array 10 can be operated at atmospheric pressures (or near-atmospheric pressure) such that there is only a small (if any) pressure differential between the inside and outside of the lamp. An experimental embodiment vacuum sealed lamp was operated in 745 Torr He. The radiating area of the device was 5 cm$^2$, and it had an overall thickness (including the packaging 34) of approximately 35 μm. The experimental device could be bent at an angle of more than 40° (with respect to the plane of a flat lamp) without damage the lamp.

Arrays of the invention have many applications. One application for an array, for example, is as the light source (backlight unit) for a liquid crystal display panel. Embodiments of the invention provide a lightweight, thin and distributed source of light that is preferable to the current practice of using a fluorescent lamp. Distributing the light from the lamp in a uniform manner over the entire display requires sophisticated optics. Arrays of the invention also have application, for example, in sensing and detection equipment, such as chromatography devices, and phototherapeutic treatments (including photodynamic therapy). The latter include the treatment of psoriasis which requires ultraviolet light at ~308 nm, actinic keratosis and Bowen's disease or basal cell carcinoma. Inexpensive arrays sealed in glass or plastic now provide the opportunity for patients to be treated in a nonclinical setting (i.e., at home) and for disposal of the array following the completion of treatment. These arrays are also well-suited for the photocuring of polymers which requires ultraviolet radiation.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the following claims.

The invention claimed is:

1. A microcavity plasma device array, comprising:

a first electrode, the first electrode being a thin conductive foil including a plurality of microcavities therein and being encapsulated in oxide;

a second electrode, the second electrode being a thin conductive foil encapsulated in oxide;

said first electrode and said second electrode being bonded together, while oxide prevents contact therebetween; and a containing layer containing discharge medium in the microcavities.

2. The array of claim 1, wherein said first and second electrodes, oxide, and the containing layer are sufficiently thin to permit the array to be flexible.

3. The array of claim 1, wherein said first and second electrodes comprise aluminum foils and said oxide comprises aluminum oxide.

4. The array of claim 1, wherein said first and second electrodes comprise titanium foils and said oxide comprises titanium oxide.

5. The array of claim 1, wherein said containing layer is substantially transparent in the visible spectrum.

6. The array of claim 1, wherein said containing layer comprises an optical filter.

7. The array of claim 1, comprising microcavities in each of said first and second electrodes.

8. The array of claim 1, wherein said containing layer comprises glass.

9. The array of claim 1, wherein said containing layer comprises polymeric vacuum packaging and said discharge medium is contained in the array at approximately atmospheric pressure.

10. The array of claim 1, further comprising a first dielectric thin film upon the oxide of said first electrode.

11. The array of claim 10, further comprising a second dielectric thin film upon the oxide of said second electrode.

12. The array of claim 11, wherein said first and second dielectric thin films comprise glass.

13. The array of claim 1, wherein said second electrode comprises a capacitor.

14. A method of manufacturing a microcavity plasma device array, the method comprising steps of:

encapsulating a first conductive foil having a plurality of microcavities in oxide to form a first electrode;

encapsulating a second conductive foil in oxide to form a second electrode;

bonding said first and second electrodes together;

containing discharge medium in the array.

15. The method of claim 14, wherein said step method is a roll-to-roll process.

16. The method of claim 14, wherein said first and second foils comprise aluminum foils and said oxide comprises aluminum oxide.

17. The method of claim 14, wherein said first and second foils comprise titanium foils and said oxide comprises titanium oxide.

18. The method of claim 14, wherein the oxide of said first and second conductive foils are additionally coated with a dielectric thin film.

19. The method of claim 18, wherein said dielectric thin film comprises glass.

20. The method of claim 14, wherein said step of containing comprises vacuum packaging the first and second electrodes to contain discharge medium in the array.

* * * * *

UNITED STATES PATENT AND TRADEMARK OFFICE

CERTIFICATE OF CORRECTION

PATENT NO. : 7,385,350 B2
APPLICATION NO. : 11/487949
DATED : June 10, 2008
INVENTOR(S) : Eden et al.

It is certified that error appears in the above-identified patent and that said Letters Patent is hereby corrected as shown below:

On the Title Page of the Patent:

In the First Column
(73) Assignee: Please delete, "The Broad of Trusstees of the" and insert in its place, --The Board of Trustees of the--

In the Second Column
OTHER PUBLICATIONS Please delete, "Jounral of Applied Physics" and insert in its place, --Journal of Applied Physics--

Signed and Sealed this

Fourth Day of November, 2008

JON W. DUDAS
*Director of the United States Patent and Trademark Office*